United States Patent [19]

Krulwich

[11] 4,265,624

[45] May 5, 1981

[54] MAGNETIC TRACING STAND

[76] Inventor: Lester S. Krulwich, 241 Central Park West, New York, N.Y. 10024

[21] Appl. No.: 112,186

[22] Filed: Jan. 15, 1980

[51] Int. Cl.[3] ..... B43L 5/02

[52] U.S. Cl. ..... 434/88; 248/441 A; 362/97

[58] Field of Search ..... 35/7 A, 19 B, 26, 60; 40/361, 426; 248/206 A, 441 A, 467; 269/8, 11; 362/97, 98, 398

[56] References Cited

U.S. PATENT DOCUMENTS

| | | | |
|---|---|---|---|
| 1,490,917 | 4/1924 | Finkelstein | 362/97 X |
| 1,591,957 | 7/1926 | Berry | 40/361 |
| 2,328,471 | 8/1943 | Leffel | 362/97 X |
| 2,474,942 | 7/1949 | Hawkins | 248/206 A |
| 2,570,806 | 10/1951 | Henry . | |
| 2,883,770 | 4/1959 | Lieb . | |
| 3,280,478 | 10/1966 | Strickler | 35/19 B |
| 3,952,989 | 4/1976 | Hatcher . | |

FOREIGN PATENT DOCUMENTS

| | | | |
|---|---|---|---|
| 593036 | 11/1977 | Switzerland | 434/162 |
| 19209 | of 1913 | United Kingdom | 362/97 |
| 1478012 | 6/1977 | United Kingdom | 248/441 A |

*Primary Examiner*—Harland S. Skogquist

[57] ABSTRACT

A magnetic tracing stand capable of being illuminated by various sources of battery operated lights, such as flashlights, lanterns, and by household light fixtures, consisting of a magnetically attractable surfaced base, a rigid, adjustably angled transparent sheet that is removably and reversibly fastened to the front of the base leaving open space over a major portion of the base, with magnetic and fastening means, to accommodate and utilize various sources of light.

7 Claims, 8 Drawing Figures

MAGNETIC TRACING STAND

This invention relates to a magnetic tracing stand with lighting that operates primarily on batteries and lighting from a variety of sources such as lamps and other household light fixtures. Tracing outfits with lighting are now in different boxes having electric bulbs with extension cords or are fluorescent. These structures are limited in their use and quite expensive. Also they often carry big letter warnings to be careful of electric shock, and are obviously not suitable for all ages.

An important object of this invention is to provide a magnetic tracing stand that is inexpensive to make and will substantially eliminate the need for tracing paper and other methods of tracing.

Another object of this invention is to provide a magnetic tracing stand primarily using battery operated lighting without requiring regular electric current, extension cords and outlets.

Another object of this invention is to provide a magnetic tracing stand that receives lighting from a variety of household and other readily available sources.

Another object is to provide a magnetic tracing stand that can be operated easily and inexpensively in different ways with different sources of light.

Further objects and structural details of the invention will be apparent from the following description when read in conjunction with accompanying drawings forming a part of this specification, wherein.

Figure 5:
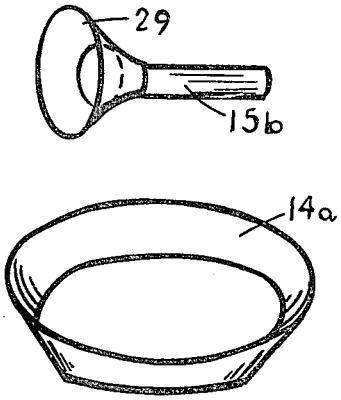

FIG. 5 has views of a flashlight with an enlarged reflector, and the magnetically attractable base having a reflecting bowl-like shape.

Figure 6:
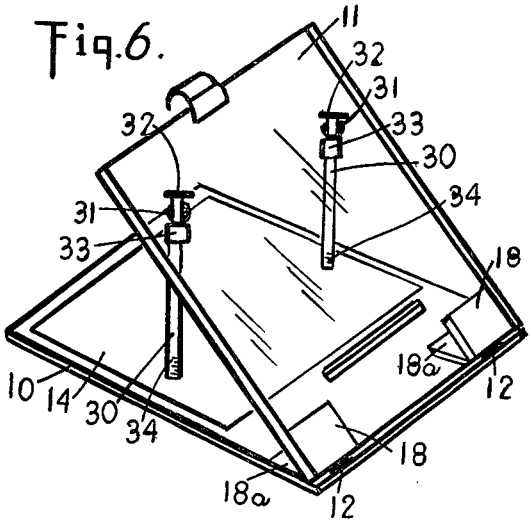

FIG. 6 is a view of the optional posts controlling the slanting angle of the transparent sheet.

Figure 1:
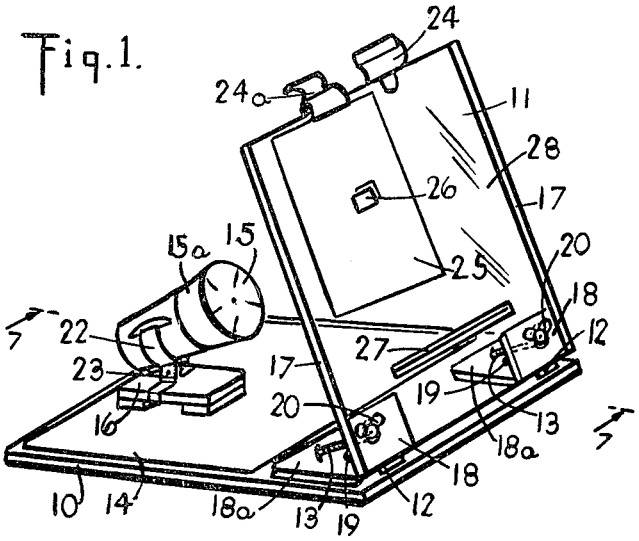
FIG. 1 is a perspective view of an embodiment of my invention.
Figure 2:
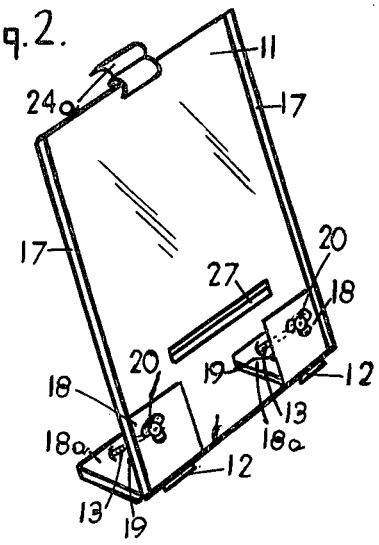
FIG. 2 is a perspective view showing the transparent sheet with fastening hinge and bolt members, without the rectangular base.
Figure 3:
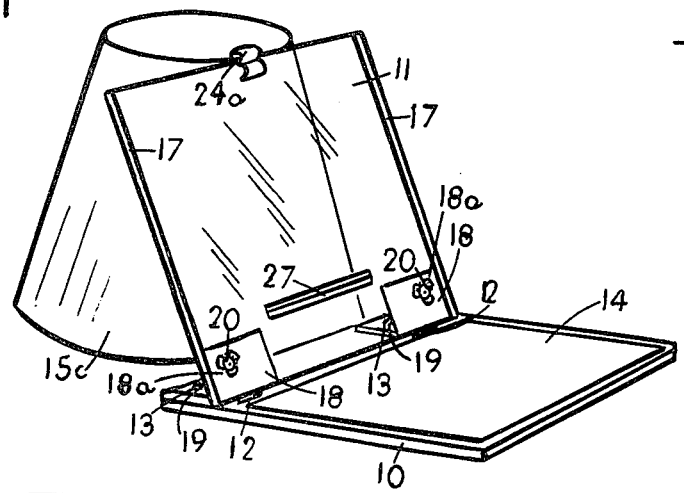
FIG. 3 is a perspective view of the tracing stand, with the transparent sheet and hinge members reversed, on a lamp shade.
Figure 4:
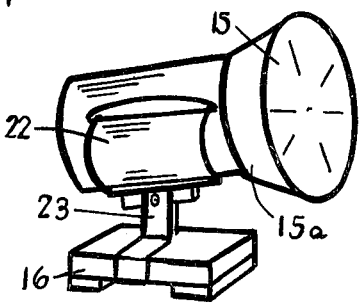
FIG. 4 is a perspective view of a lantern on its magnetic base with side and top angles.
Figure 7:
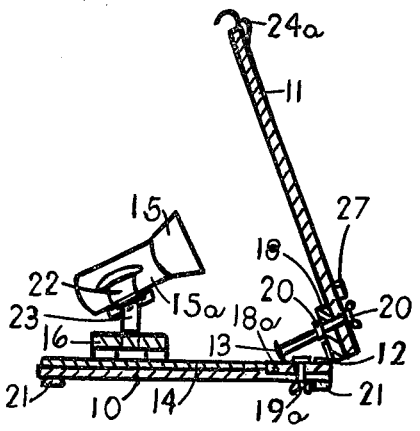

FIG. 7 is a section on line 7—7 of the main features of FIG. 1.

Figure 8:
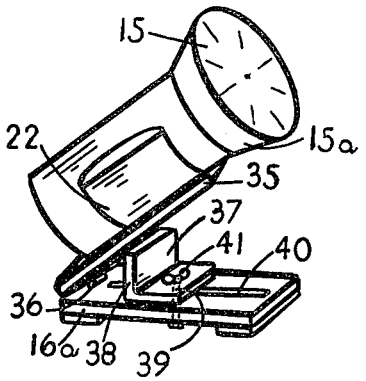

FIG. 8 is a perspective view of a light member on an optional magnetic base.

Upon reference to the drawings, they show a thin rectangular base 10, having a fairly rigid transparent sheet 11 fastened with hinge members 12 and bolts 13 controlling the slant of the transparent sheet 11. The transparent sheet 11, with the hinge members 12 and bolts 13, are fastened on the front portion of the base 10, capable of being removed and refastened there, facing the opposite direction. The surface of the rectangular base 10 is of magnetically attractable material 14 and on it a battery operated light 15 is removably and adjustably held on a magnetic base 16.

The relatively thin rectangular base 10 is, for example $\frac{1}{8}$ inch plywood 12 inches long and $10\frac{1}{2}$ inches wide, with the fairly rigid transparent sheet 11, such as glass or plastic 12 inches long and 10 inches wide, optionally with reinforcing side strip edgings 17. The bottom of the transparent sheet 11 is fastened on two side pieces 18 that are hinged 12 to similar pieces 18*a*. These similar pieces 18*a* are removably fastened 19 to the front of the rectangular base 10, with wing nuts 19*a* on the back of the rectangular base 10. A bolt 13 extends through each side piece 18 and the bottom of the transparent sheet 11, and heads of each bolt 13 press against each similar side piece 18*a*. The extent to which the bolts 13 extend out against the similar side pieces 18*a* control the slant of the attached transparent sheet 11. The bolts 13 are held by a nut 20 on both sides of each side piece 18, to which the transparent sheet 11 is attached. The nuts 20 are each tightened towards each other at a selected position, and that way the hinges 12 and the transparent sheet 11 are held firmly at a desired slant.

Round felt pads 21 or other suitable material are optionally fastened under each corner of the rectangular base 10. They extend outwards beyond the wing nuts 19*a*. Also the thickness of the pads 21, especially those up front, can help set the slant of the transparent sheet 11.

The side pieces 18, 18*a* and the transparent sheet 11 with the attached parts can be removed from the rectangular base 10 by unscrewing the back wing nuts 19*a*. The transparent sheet 11 with the side pieces 18, 18*a* and hinges 12 can then be turned to face the opposite direction and refastened. For a tracer then on the other side of the rectangular base 10 the transparent sheet 11 still slants back.

The major portion of the top surface of the rectangular base 10 contains magnetically attractable material 14 such as sheet iron or iron mesh. A light member 15, preferably battery powered, such as a lantern 15*a* or flashlight 15*b*, is removably and adjustably mounted on a magnetic base 16, for example with flexible material 22 held tight by magnetic tape, Velcro or elastic, and the flexible material 22 then mounted on a magnetic base 16 with a ball socket, side angles or other suitable means 23. This magnetic base 16 movably and magnetically adheres to the magnetically attractable rectangular base 10, having magnets on the bottom.

A fastener 24 is attached to the top of the transparent sheet 11, capable of holding copy 25. Also as part of this fastener 24 or independently, a fastener 24*a* is attached there, as a clip and bent over piece, that can connect the transparent sheet 11, with other parts, to a different source of light, such as a household lamp 15*c* or other light fixture. Optionally magnets 26 may be provided for both sides of the transparent sheet 11 to hold the tracing copy 25 in any position. A ledge 27 is also fastened on the transparent sheet 11 near the bottom, optionally, adjustably held by magnets 26.

The transparent sheet 11 is preferably coated lightly 28 to prevent light glare. The rectangular base 10 and other parts may have a reflective coating like white or aluminum. A flashlight 15*b* may be provided with an enlarged reflector 29 by removably attaching to it a reflector 29 shaped like the frustum of a cone, open on both ends with its smaller opening adjustably fastened, for example with magnetic tape or Velcro, to the conventional reflector of the flashlight 15*b* and the larger opening having a wide diameter such as 3 or more inches.

The light holder 16,22 can optionally be structured to hold a bulb having a wire or extension cord connected with a battery, such as a storage battery, and the light holder 16,22 can also optionally be sized to accommodate a socket and bulb. Other sources like fiber light may also be employed on the rectangular base 10.

Instead or with the bolts 13 and nuts 20 on the side pieces 18, optionally posts 30 are fastened, preferably removably, on the rectangular base 10 about midway near each of its longitudinal sides, within the hinged path of the transparent sheet 11. The transparent sheet 11 has a hole 31 on each side that moves freely on each of the posts 30 under removable caps 32 on the posts 30. The posts 30 contain adjustable blocking means 33 such as magnetic tape, Velcro or snap fasteners that extend outward wider than the diameter of the holes 31 limiting and setting the back slant of the transparent sheet 11. The top caps 32 and bottom of the posts 30 are preferably threaded 34 for fastening.

Optionally the light member 15 can be removably fastened on a rectangular support 35 hinged 36 to the magnetic base 16*a*. A right angular member 37 has a vertically upward side 38, and holds a screw 39 movable in a longitudinal slot 40 in this magnetic base 16*a*. The bottom of the support 35 leans on the top of the vertical side 38, and a nut 41 locks the screw 39 of the angular member 37, setting the support 35, with the light member 15, at a desired angle, as shown in FIG. 8.

OPERATION OF THE APPARATUS

Tracing even through bristolboard is done clearly and quickly with this device. The light from the magnetic base 16, movably positioned on the magnetically attractable base 14, is constantly focused on any portion of the transparent sheet 11. The side pieces 18, 18*a* with their parts, removably fastened on the front of the rectangular base 10, firmly balance the transparent sheet 11 for tracing.

The tracer has a number of choices with this inexpensive structure—9 volt batteries, flashlights, storage batteries, fiber light. Also the transparent sheet 11 and rectangular base 10 can be fastened or placed next to a household lamp 15*c* or other light fixture, and excellent tracing done without using the magnetic holder 16. The transparent sheet 11 is not placed in direct contact with any bulb, but to set it closer the side pieces 18,18*a* and their parts, with the transparent sheet 11, can be unscrewed from the rectangular base 10, reversed and screwed back. With the rectangular base 10 turned around, the clip or bent over piece 24*a* can then be removably fastened on the light fixture, for example a light shade. Here the sheet 11 still slants back and the base 10 extends out toward the tracer, and may be used as a small platform. Instead the tracer may use the transparent sheet 11 and other parts without the rectangular base 10, perhaps finding it more convenient. With the different methods of handling the light always shines on and through the back of the transparent sheet 11, and like a magnifying glass, it is often focused a little bit from or to a lamp or other source of light.

The attachable enlarged reflector 29 is important because it makes all good flashlights 15*b* suitable for tracing with this device. Also battery lanterns 15*a*, in plastic, have become inexpensive and are very effective with this tracing stand, helping to make the cost very low compared to tracing boxes. The magnetically attractable base 10 may itself be shaped like a reflector 29 by having its surface 14 reflective and sloping outwardly upwards bowl-like 14*a*.

Tracing is with the material on the outside of the transparent sheet 11 and the top clip 24 or ledge 27 can help hold the material. The magnets 26 on each side of the transparent sheet 11 help position the work, especially since their magnetic fields extend strongly through the transparent sheet 11. But the magnets 26 also hold designs in different positions behind the transparent sheet 11, to be traced by themselves or as part of the material on the front side, serving almost like attached templates, and can also hold a magnetic ledge 27.

I have described preferred embodiments of my invention but it is understood that various changes may be made in the form, details, arrangements and proportions of the various parts without departing from the scope of my invention.

What I claim is:

1. A magnetic tracing stand comprising a thin, fairly rigid transparent sheet fastened to a rectangular magnetically attractable base, said transparent sheet slanting adjustably backwards, and a light member adjustably mounted on a magnetic base capable of adhering magnetically and movably to said magnetically attractable base and having the light member focus its light on and through said transparent sheet permitting tracing on the other side of said transparent sheet.

2. A magnetic tracing stand according to claim 1, comprising said transparent sheet fastened on a front portion of a narrower side of said magnetically attractable base, slanting backwards, with open space over said magnetically attractable base, accommodating a light member fastened on said magnetic base, and a ledge fastened near the bottom of said transparent sheet.

3. A magnetic tracing stand according to claim 1, said transparent sheet capable of being removed from said magnetically attractable base and turned around to face the opposite direction and be refastened, with said transparent sheet having fastening and setting means, with and without being attached to said magnetically attractable base, to receive light on and through the back of said transparent sheet from various light fixtures for tracing.

4. A magnetic tracing stand according to claim 1, said light member provided with an enlarged reflector removably attached to it, shaped like the frustum of a cone, open on both ends with its smaller opening adjustably fastened to the front of said light member and the larger opening having a relatively wide diameter.

5. A magnetic tracing stand according to claim 1, said magnetically attractable base having a reflective surface, sloping outwardly upwards, bowl-like.

6. A magnetic tracing stand according to claim 1, with said transparent sheet provided with magnets on each side capable of magnetically holding and positioning tracing material on both sides of the transparent sheet.

7. A magnetic tracing stand according to claim 1, with fastening and bent-over members attached to the top of said transparent sheet capable of holding tracing material on said transparent sheet and said transparent sheet on light fixtures for tracing.

* * * * *